US006663383B2

(12) United States Patent
Jon

(10) Patent No.: US 6,663,383 B2
(45) Date of Patent: Dec. 16, 2003

(54) UTILITY LIGHTER WITH A SAFEGUARD

(76) Inventor: Jong-Koo Jon, 209-508 Hyundai Apt., 311-326 Sangok, Bupyung, Incheon City (KR)

( * ) Notice: Subject to any disclaimer, the term of this patent is extended or adjusted under 35 U.S.C. 154(b) by 0 days.

(21) Appl. No.: 10/233,239

(22) Filed: Sep. 3, 2002

(65) Prior Publication Data

US 2003/0049576 A1 Mar. 13, 2003

(30) Foreign Application Priority Data

Sep. 7, 2001 (KR) ..... 2001-0055132

(51) Int. Cl.[7] ..... F23D 11/36; F23Q 7/12
(52) U.S. Cl. ..... 431/153; 431/255
(58) Field of Search ..... 431/153, 255, 431/344, 345, 277, 151

(56) References Cited

U.S. PATENT DOCUMENTS 5,171,143 A * 12/1992 Sohn ..... 431/153
5,368,473 A * 11/1994 Kenjiro et al. ..... 431/153
6,135,762 A * 10/2000 Hu ..... 431/255
6,296,476 B1 * 10/2001 Tsai ..... 431/255

* cited by examiner

*Primary Examiner*—James C. Yeung
(74) *Attorney, Agent, or Firm*—Charles E. Baxley

(57) ABSTRACT

The present invention provides a utility lighter with a safeguard that prevents inadvertent activation by children. Inside the lighter shell, the piezoelectric unit is located between the trigger and the safety button. When the trigger is pulled or pushed, the piezoelectric unit is moved. This movement can either be blocked by the safety button, or allowed to take place alongside the movement of the safety button. When the user holds the safety button and pulls the trigger simultaneously, the piezoelectric unit is blocked and generates a spark. If the trigger is pressed alone it stops before the piezoelectric unit is activated because of its movement backward. Children will find it very difficult to pull the trigger while retaining the safety button, vastly decreasing their chances of activating the lighter.

8 Claims, 7 Drawing Sheets

UTILITY LIGHTER WITH A SAFEGUARD

BACKGROUND OF THE INVENTION

1. Field of the Invention

The present invention relates to a fuel-gas lighter—more particularly a utility lighter with a safeguard.

2. Description of Prior Art

Utility lighters are used for inflaming barbeque grills, fireplaces, candles, and other firing fields in daily life. Such a lighter, as shown in FIG. 5 and FIG. 6, is comprised of a gas container 4, a shell 2, and a long rod-like tube 3 for inflaming objects in hard-to-reach places. The gas container 4 contains highly compressed inflammable gas. Fuel lever 6 controls the opening and closing of gas container 4's outlet. The friction force generated by pressing down trigger 8 activates piezoelectric unit 7 that is located on the inside of shell 2, and releases the fuel to inflame the lighter.

When the user presses said trigger 8 with his finger, it contacts said lever 6, lifting the valve to emit the gas from container 4 to the end of tube 3. The pressing motion also activates the piezoelectric unit, generating a spark at the outside tip of barrel portion 3, which in turn creates the flame.

Although this utility lighter conveniently inflames objects in hard-to-reach places by keeping the user's hand and face away from the flame, its gun-like shape promotes unsafe behavior in children who may mistake the lighter for a toy. Such behaviors may lead to fires and burn injuries. To prevent the utility lighter from being activated inadvertently by children, many lighters in the market are now equipped with a trigger-locking device.

A conventional utility lighter, such as that shown in FIG. 7, has a sliding switch 20 mounted on the handle's side. When the switch 20 is set to the "On" position, the switch's stopper withdraws from trigger 8, allowing it to slide freely. Conversely, when the switch 20 is set to the "Off" position, the switch's stopper blocks trigger 8, preventing the steps necessary to create a flame. Unfortunately, the users of lighters with safety functions designed in this way often forget to set switch to the "Off" position after using, defeating the purpose of the mechanism.

OBJECTS OF THE INVENTION

It is, therefore, a main object of the present invention to provide a lighter with an automatic safeguard so that inadvertent activation by children can be prevented.

The utility lighter of the present invention has a safeguard, which is comprised of a shell with a barrel portion, a gas container, a piezoelectric unit, and a safety device comprised of a trigger and a safety button. The piezoelectric unit is placed between a holding plate of the trigger and a blocking plate of the safety button that is backed by a compression spring. A locating plate is built on the shell to coordinate with the position of the safety button.

The piezoelectric unit has a sliding portion equipped with a hammer backed by a compression spring that is loaded inside the unit. The sliding portion travels the pre-set striking distance needed to hit the piezocrystal placed inside the unit for producing a spark.

The distance between the trigger's original position and the trigger's pressed position, called the trigger's travel distance, should be equal or greater than the striking distance of the sliding portion of the piezoelectric unit in order to generate a spark. Conversely, the travel distance should be lesser than the sum of the striking distance of the piezoelectric unit and the travel distance of the safety button in order to create the safeguard.

The said safety button has a blocking plate that extends inside the shell blocking the bottom end of the piezoelectric unit. A portion of the safety button extends out of the shell to form a button to be pressed by the user's thumb.

A locating plate is built inside the shell, opposite the backside of the safety button's blocking plate. A compression spring connects the two plates and holds the blocking plate upright. The elasticity of this compression spring should be less than that of the compression spring built on the inside of the piezoelectric unit.

The trigger has a holding plate at one end that extends inside the shell, holding the end of the sliding portion of the piezoelectric unit at the back-end, opposite the blocking plate of the safety button. The other end of the trigger extends to engage with the fuel lever.

SUMMARY OF THE INVENTION

A safety button is added to the common utility lighter, and a piezoelectric unit is placed between the trigger and the safety button, so it can move following the trigger action. The movement of the piezoelectric unit can be blocked or allowed, depending on whether or not the safety button is retained at its original position. When the user presses the safety button at the external of the lighter and sustains it at original position, the piezoelectric unit is blocked, and a spark is generated. If the safety button is free, the piezoelectric unit is allowed to slide backward so the trigger is unable to strike it, preventing the generation of the spark. Children will find it difficult to figure that the safety button need be pressed and sustained to create a flame. Therefore, such a lighter would greatly reduce fire damage or injury caused by a child's inadvertent activation. At the same time, an adult can use it without significant inconvenience. The structure of such a utility lighter would be simple enough to be easily manufactured.

DETAILED DESCRIPTION OF PREFERRED EMBODIMENTS

Figure 1:
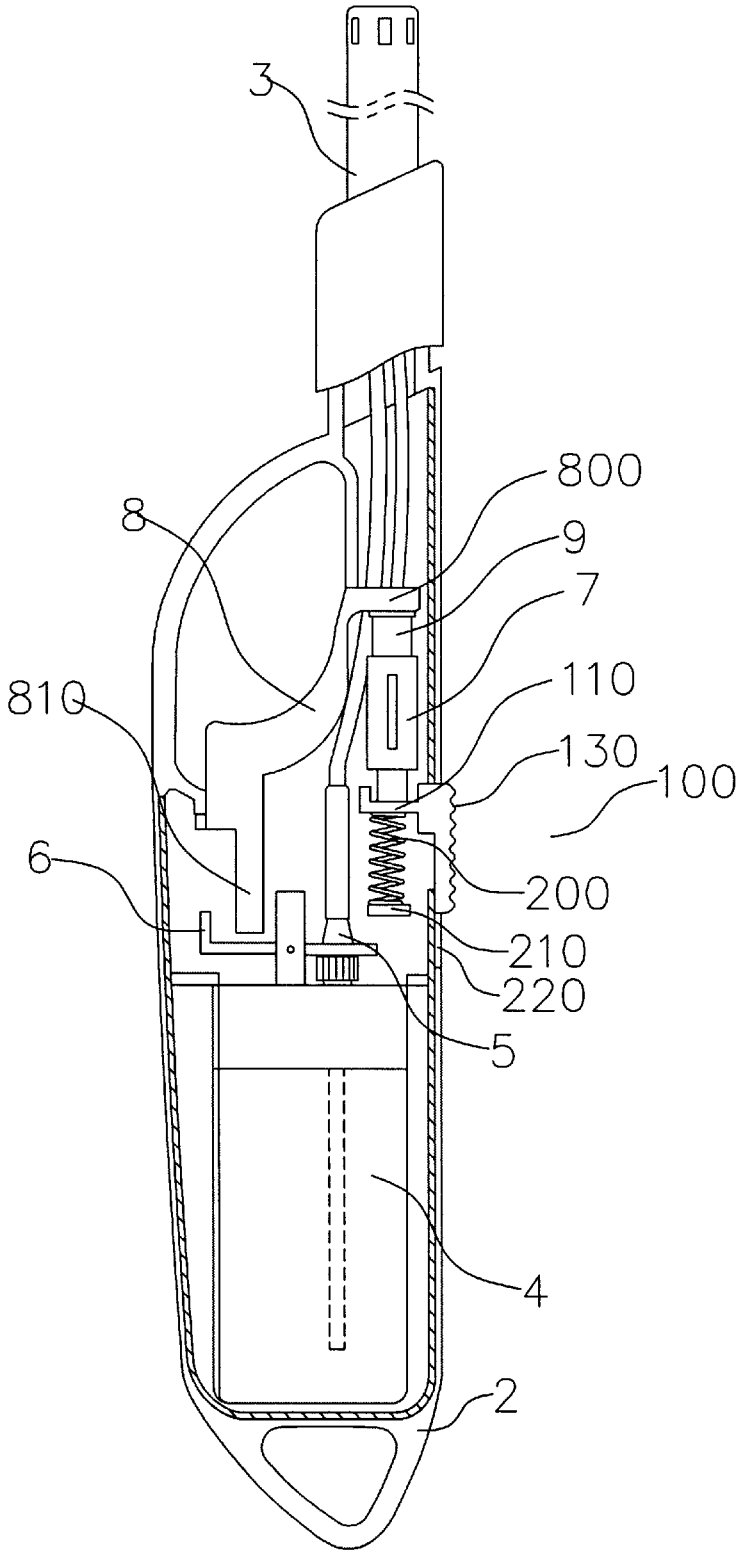
FIG. 1 is a cross-section view of the present invention.

Referring to FIG. 1, a utility lighter with a safeguard is comprised of a shell 2 including a barrel portion 3, a gas container 4, a piezoelectric unit 7, and a safety device that includes a trigger 8 and a safety button 100. Shell 2 houses gas container 4, and has a locating plate 210 that coordinates with safety button 100. A sliding rail portion 220 is located on the top so that the safety button can be mounted and moved along it.

Piezoelectric unit has a sliding portion 9 equipped with a hammer backed by a compression spring loaded inside the unit. The sliding portion 9 travels the pre-set striking distance needed to hit the piezocrystal placed inside the unit for producing a spark.

Safety button 100 has an inner portion that is placed on the inside of shell 2.

This portion houses a blocking plate 110 that blocks the bottom end of the piezoelectric unit 7. An external portion, pressing portion 130, is exposed outside the shell. Its teeth or indented surface provides a firm grip for the thumb.

A holding plate 800 is built at one end of trigger 8. It extends inside shell 2, which holds the end of the sliding portion 9 of the piezoelectric unit 7. An extending portion 810 is built on the other end of trigger 8. This portion engages with fuel lever 6 inside shell 2.

The movable piezoelectric unit 7 is placed between holding plate 800 of trigger 8 and blocking plate 110 of the safety button 100. A compression spring 200 is placed between locating plate 210 of the shell 2 and the backside of blocking plate 110 of the safety button 100. The spring 200 pushes blocking plate 110 forward to tightly sandwich piezoelectric unit u with holding plate 800 of the trigger 8. The elasticity of the said compression spring 200 is less than that of the compression spring loaded on the inside of the piezoelectric unit 7.

Figure 2:
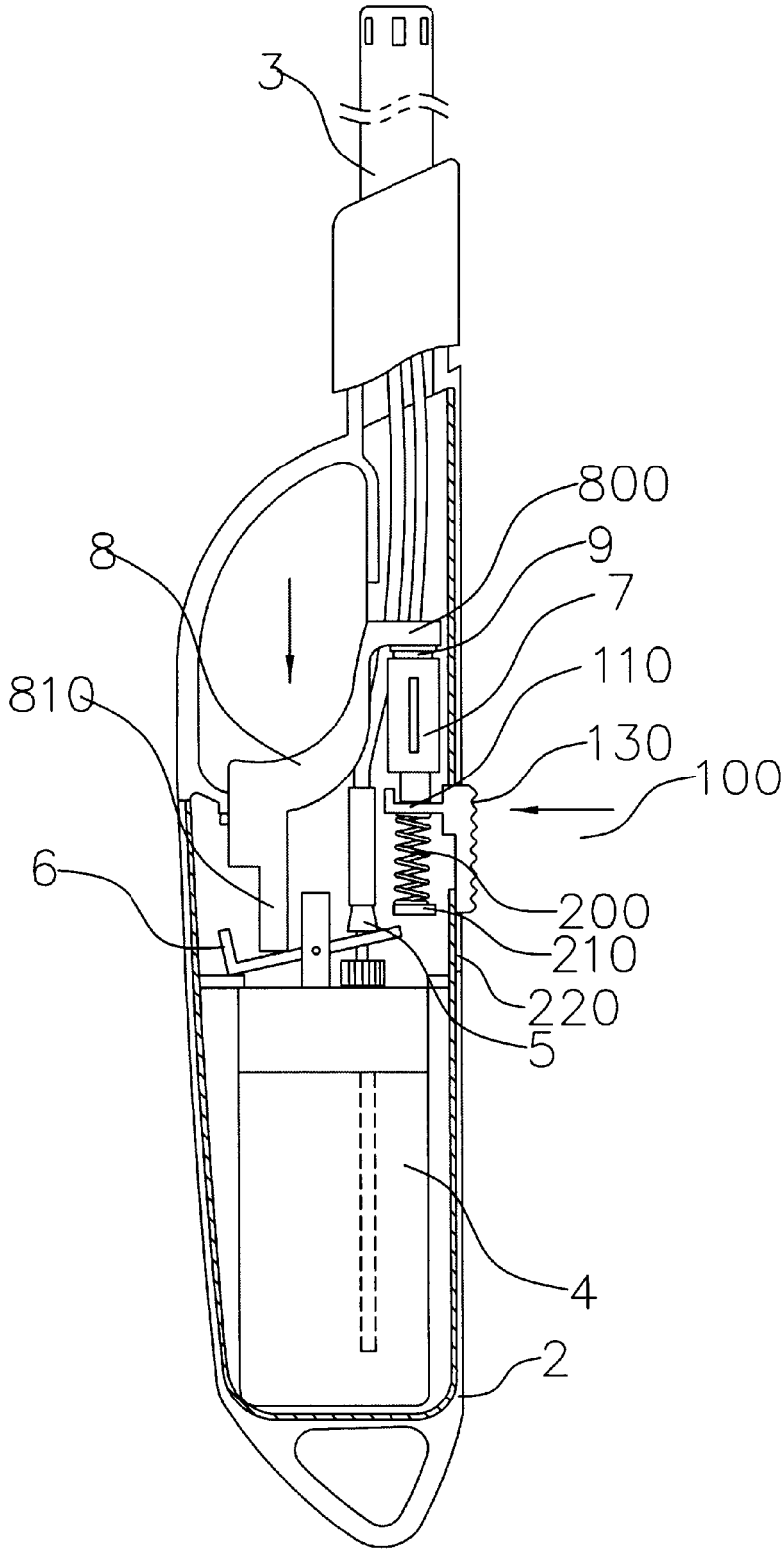
FIG. 2 is a cross-section view showing operation state of the present invention (with the safety button retained)

Referring to FIG. 2, the user presses the thumb-pressing portion 130 of the safety button 100 with his thumb, simultaneously pulling the trigger 8 with his index finger. This movement engages extending portion 810 with fuel lever 6, opening outlet 5 of gas container 4 and sending the gas to the end of the barrel 3. Because the safety button 100 is retained at its original position, the sliding portion 9 of the piezoelectric unit 7 is pressed in by the holding plate 800 of the trigger 8. As the sliding portion 9 of the unit 7 travels down its pre-set striking distance, the piezocrystal portion of the unit 7 is hit by the hammer loaded inside the unit 7, generating the spark needed at the tip end of the barrel 3 to inflame the gas.

The travel distance of trigger 8 is equal to or greater than the striking distance of the sliding portion 9 of the piezoelectric unit 7, but smaller than the sum of the striking distance of piezoelectric unit 7 and the travel distance of safety button 100.

Figure 3:
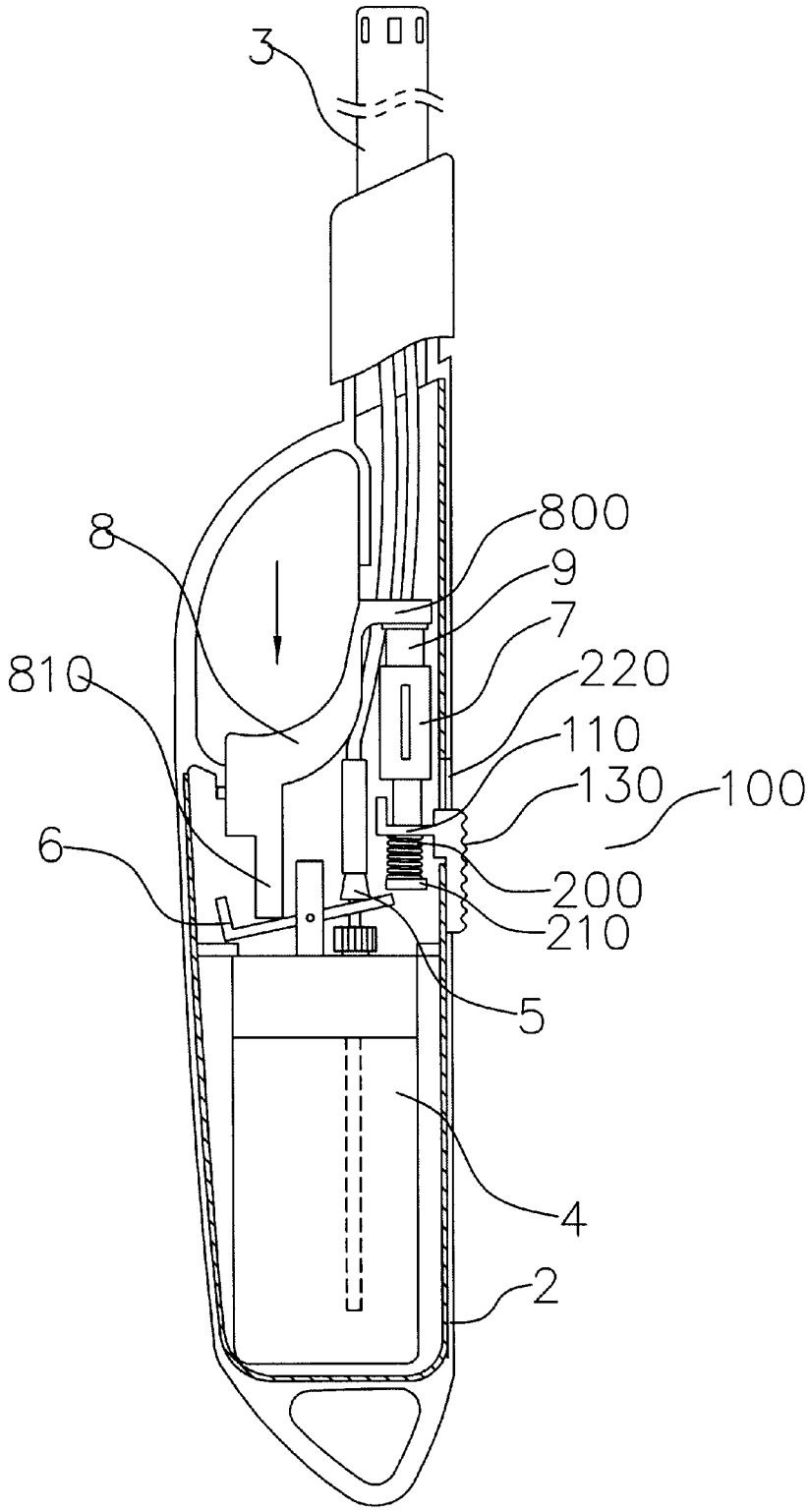
FIG. 3 is a cross-section view showing safeguard state of the safety button.

Referring to FIG. 3, when safety button 100 is not held in or up, holding plate 800 of trigger 8 will push the piezoelectric unit 7 backward along with safety button 100 and compression spring 200. Because trigger 8 slides only for a certain distance, it stops before the sliding portion 9 of the piezoelectric 7 is sufficiently compressed to hit the piezocrystal portion of the unit 7.

A child may have difficulty pulling the trigger 8 with his index finger while retaining the safety button 100 at its original position with his thumb.

Figure 4:
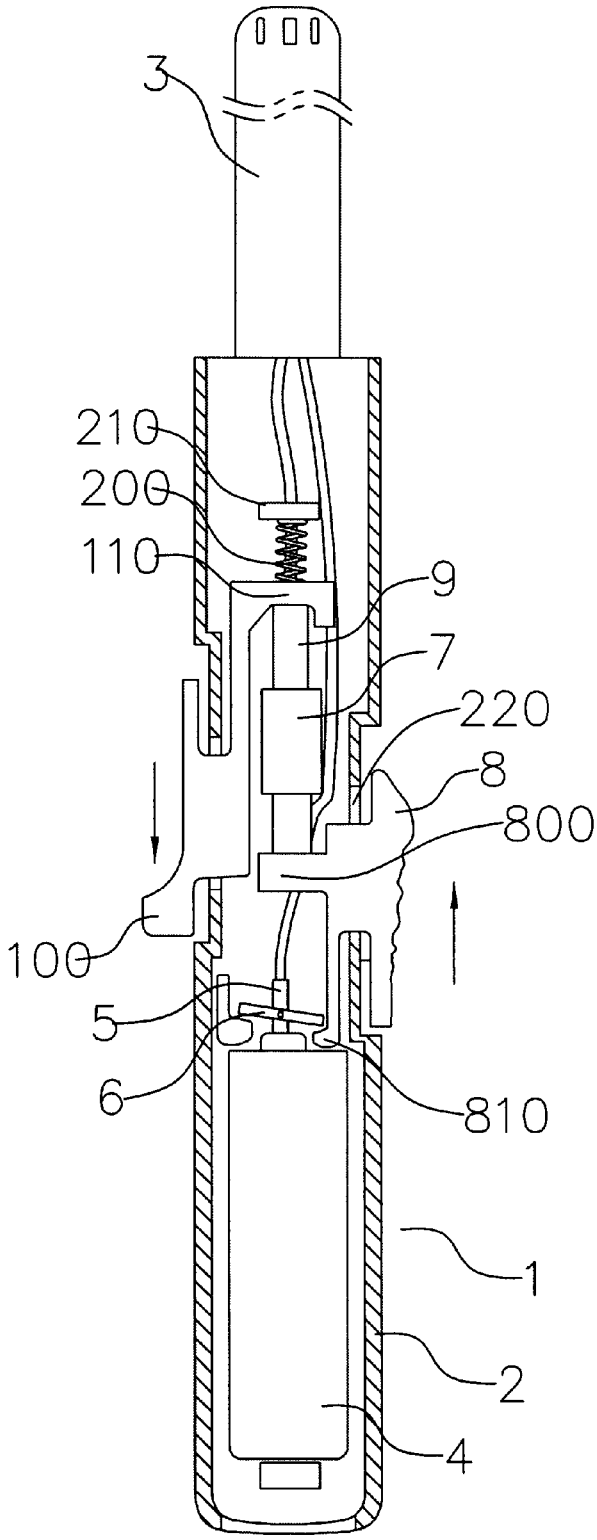
FIG. 4 is a cross section view of another embodiment of the present invention.
Figure 5:
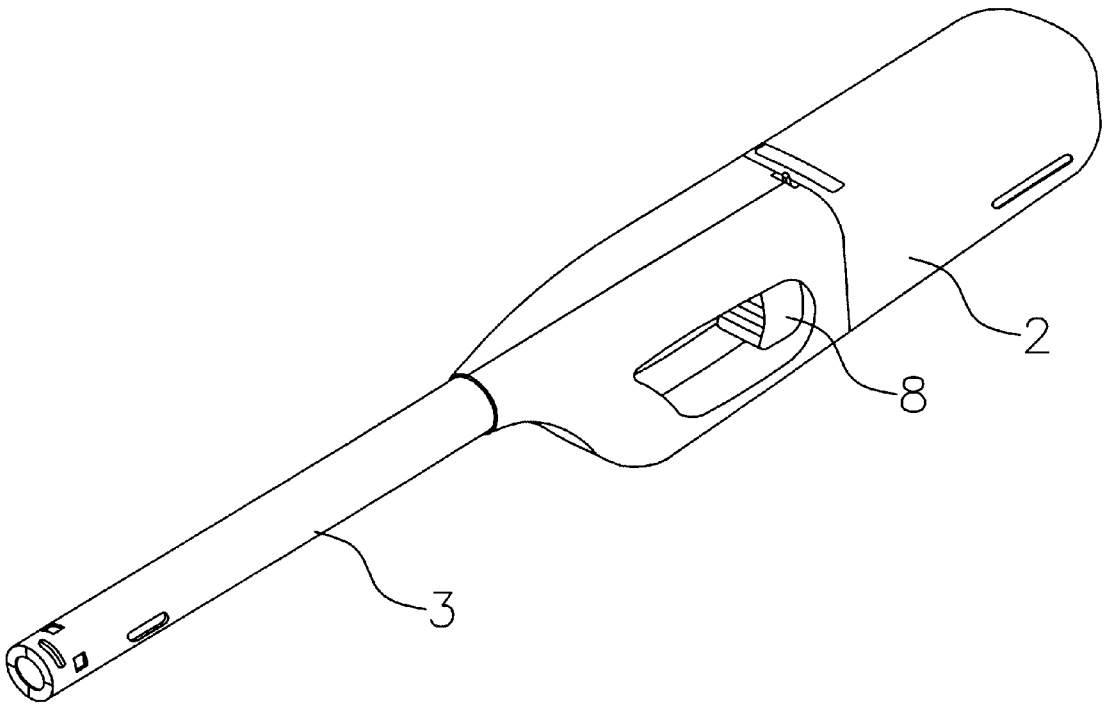
PRIOR ART FIG. 5
FIG. 5 is a solid view of a prior art.
Figure 6:
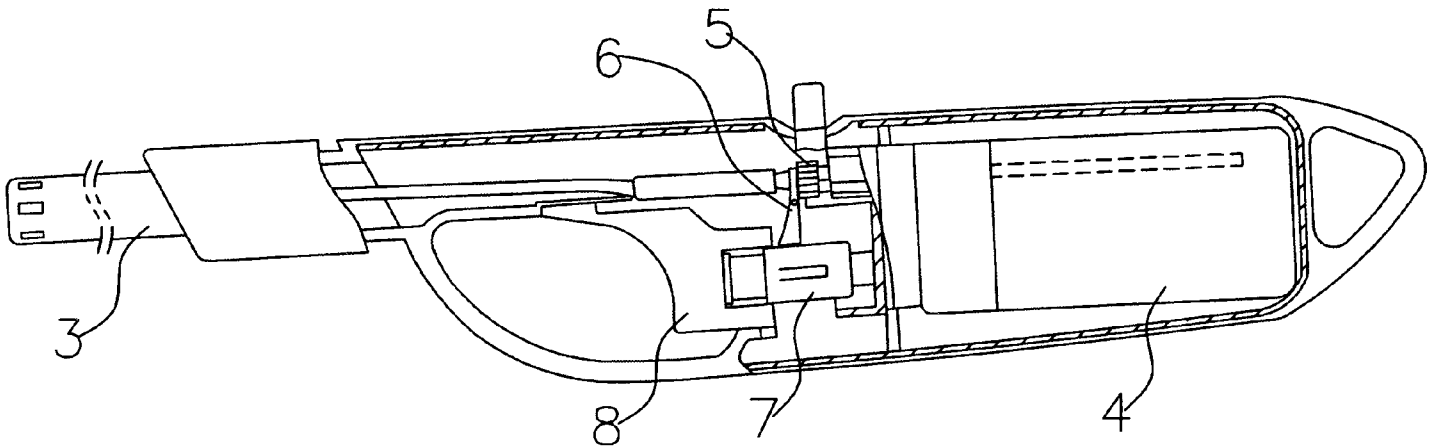
PRIOR ART FIG. 6
FIG. 6 is a cross-section view of the prior art.
Figure 7:
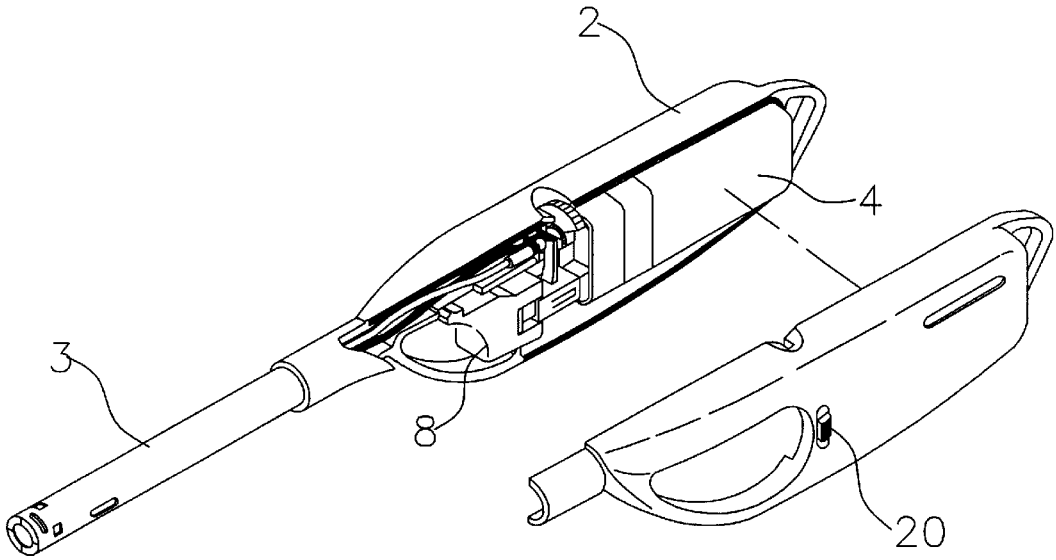
PRIOR ART FIG. 7
FIG. 7 is a part exploded view of a prior art.

Referring to FIG. 4, another embodiment of the present invention is shown in which the positions of trigger 8 and safety button 100 are exchanged. In this structure, the user must push the trigger 8 forward with his thumb while retaining the safety button 100 with his index finger.

What is claimed is:

1. A utility lighter with a safeguard comprising:

a shell with said shell having a barrel portion;

a gas container disposed in said shell;

a piezoelectric unit movably disposed in said shell;

a rail mounted on said shell, and a safety device disposed in said shell with said safety device comprising;

a trigger, with said bigger having a holding plate, and a safety button, with said safety button having a blocking plate and with said safety button movably mounted on said rail, with said piezoelectric unit disposed between said holding plate and said blocking plate, with said piezoelectric unit movable relative to said shell responsive to motion of said trigger, with motion of said piezoelectric unit either blocked or allowed responsive to the position of said safety button relative to said shell.

2. The utility lighter with a safeguard as claimed in claim 1 wherein said gas container comprises:

a fuel lever and wherein said holding plate comprises:

an extending portion with said extending portion engaging said fuel lever and with said holding plate holding said piezoelectric unit.

3. The utility lighter with a safeguard as claimed in claim 1 wherein said trigger has a travel distance, wherein said piezoelectric unit has a sliding portion, wherein said sliding portion of said piezoelectric unit has a striking distance, wherein said safety button has a travel distance and wherein said travel distance of said trigger is smaller than the sum of said striking distance of said piezoelectric unit and said travel distance of said safety button.

4. The utility lighter with a safeguard as claimed in claim 1 wherein said blocking plate comprises:

a inner portion, with said inner portion disposed within said shell and disposed blocking said piezoelectric unit, and an outer portion with said outer portion disposed outside said shell to serve as a thumb-pressing portion.

5. The utility lighter with a safeguard as claimed in claim 1 further comprising:

a locating plate disposed in said shell;

a first spring with said first spring bearing against said locating plate and bearing against said blocking plate to sandwich said piezoelectric unit between said holding plate of said trigger and said blocking plate.

6. The utility lighter as claimed in claim 2 further comprising:

a locating plate, and a first compression spring connecting said locating plate and said safety button.

7. The utility lighter with a safeguard as claimed in claim 4 further comprising:

a locating plate with said locating plate disposed in said shell;

a compression spring with said compression spring bearing against said locating plate and said safety button to sandwich said piezoelectric unit and said trigger.

8. The utility lighter with a safety guard as claimed in claim 6 further comprising:

a second compression spring with said second compression spring mounted in said piezoelectric unit, with said second compression spring having elasticity with said first compression spring having elasticity and with said elasticity of said first compression spring smaller than that of said second compression spring.

* * * * *